US006098237A

United States Patent [19]

Yasoshima

[11] Patent Number: 6,098,237

[45] Date of Patent: Aug. 8, 2000

[54] BUFFER BRUSH FOR STENCILING

[75] Inventor: Rira Yasoshima, Tokyo, Japan

[73] Assignee: Tsukinek, Inc., Redmond, Wash.

[21] Appl. No.: 09/042,320

[22] Filed: Mar. 13, 1998

Related U.S. Application Data

[63] Continuation-in-part of application No. 08/747,354, Nov. 12, 1996, Pat. No. 5,870,796.

[30] Foreign Application Priority Data

Feb. 15, 1996 [JP] Japan ..... UWY 8001

[51] Int. Cl.[7] ..... A46B 5/04

[52] U.S. Cl. ..... 15/227; 15/244.1

[58] Field of Search ..... 15/143.1, 104.001, 15/104.94, 244.1, 244.4, 227; 101/405, 406, 333; 401/6

[56] References Cited

U.S. PATENT DOCUMENTS

| | | |
|---|---|---|
| D. 184,720 | 3/1959 | Fleming . |
| D. 247,063 | 1/1978 | Funahashi . |
| D. 252,935 | 9/1979 | Henkels . |
| D. 331,418 | 12/1992 | Winston . |
| D. 345,826 | 4/1994 | Byars et al. . |
| D. 347,089 | 5/1994 | Byars et al. . |
| D. 369,384 | 4/1996 | Yasoshima . |
| D. 372,731 | 8/1996 | Yasoshima . |
| D. 381,038 | 7/1997 | Yasoshima . |
| D. 381,357 | 7/1997 | Yasoshima . |
| D. 382,581 | 8/1997 | Yasoshima . |
| D. 389,174 | 1/1998 | Yasoshima . |
| D. 389,509 | 1/1998 | Yasoshima . |
| 602,061 | 4/1898 | Echelberger . |
| 771,435 | 10/1904 | Metcalf . |
| 848,063 | 3/1907 | Sommer . |
| 1,173,092 | 2/1916 | Bickerton . |
| 1,463,718 | 7/1923 | Munson . |
| 1,478,388 | 12/1923 | Gray . |
| 1,598,538 | 8/1926 | Mann . |
| 1,796,137 | 3/1931 | Baumgarten . |
| 2,117,470 | 5/1938 | Zareko . |
| 2,173,451 | 12/1939 | Lorber . |
| 2,237,969 | 4/1941 | Olsen . |
| 2,290,488 | 7/1942 | Munson . |
| 2,374,198 | 4/1945 | Harris . |
| 2,422,814 | 6/1947 | Alexander . |
| 2,644,582 | 7/1953 | Kammann . |
| 2,723,476 | 11/1955 | Lyon . |

(List continued on next page.)

FOREIGN PATENT DOCUMENTS

| | | |
|---|---|---|
| 546609 | 9/1957 | Canada . |
| 167 380 | 1/1996 | European Pat. Off. . |
| 2675740 A1 | 10/1992 | France . |
| 662905 | 6/1938 | Germany . |
| 4-312881 | 11/1992 | Japan . |
| 4940 | 4/1896 | United Kingdom . |
| 200246 | 7/1923 | United Kingdom . |
| 2045687 | 11/1980 | United Kingdom . |

OTHER PUBLICATIONS

Rubber stamp catalog, Clearsnap, Inc., 1990.
Tsukineko, Color Palette Pigment Stamp Pad Catalog, Japanese language document No Date.
Tsukineko, Japanese Catalog, 1993.
Clearsnap, Color Box Pigment Stamp Pads, See circled stamp pad, top left, 1993.
Ink–A–Dink–A–Do, *4 Inks in Ones*, Stamp Pad No Date.

*Primary Examiner*—Terrence R. Till
*Attorney, Agent, or Firm*—Seed Intellectual Property Law Group, PLLC

[57] ABSTRACT

A buffer brush for stenciling with which the user's hand will not get tired even if it taps the handle for a long time to stencil ink, and the close contact of the ink absorbing part and the stencil will be good. The buffer brush comprises an ink absorbing part on a handle which is made of buffer material. The buffer brush can also comprise an orifice into which the user can insert a finger, retaining the buffer brush to the finger and further allowing the user to relax the hand.

18 Claims, 4 Drawing Sheets

U.S. PATENT DOCUMENTS

| | | | |
|---|---|---|---|
| 2,873,464 | 2/1959 | Rosenthal . | |
| 3,142,855 | 8/1964 | Gilchrist | 15/244.1 |
| 3,326,180 | 6/1967 | Lofgren . | |
| 3,590,734 | 7/1971 | Carter . | |
| 4,029,011 | 6/1977 | Kurner . | |
| 4,283,808 | 8/1981 | Beebe . | |
| 4,986,175 | 1/1991 | Boehringer et al. . | |
| 5,531,829 | 7/1996 | Yasoshima . | |
| 5,601,644 | 2/1997 | Yasoshima . | |
| 5,653,804 | 8/1997 | Yasoshima . | |
| 5,671,497 | 9/1997 | Abdo . | |

BUFFER BRUSH FOR STENCILING

CLAIM FOR PRIORITY

This is a continuation-in-part of U.S. patent application Ser. No. 08/747,354, filed Nov. 12, 1996 now U.S. Pat. No. 5,870,796.

TECHNICAL FIELD OF THE INVENTION

The present invention pertains to stencil brushes, particularly brushes for stenciling that are less tiring for the user because the brushes have buffer characteristics, are fitted over the user's fingertip, or both.

BACKGROUND OF THE INVENTION

Conventionally, stenciling is done as follows: Stencils with letters, figures, or designs cut out are laid over a sheet of paper. Watercolors (water-soluble paint), or ink from a stamp pad is transferred to a stencil brush, then the artist colors by slightly tapping the stencil brush on the top of the stencil. Then, afterward, the stencil is removed and the letters, figures, or designs are copied.

Stencil brushes used for conventional stencils can have, as illustrated in FIG. 1, a brush 13 of animal hair, etc., attached to the tip of a wooden or bamboo handle 11, or as illustrated in FIG. 2, an ink absorbing part 12 of polyurethane sponge, etc., attached to the tip of a handle 11 of wood, bamboo, or hard plastic. The artist can hold the handle 11 with his or her fingers in the same manner as a pencil, and color with ink by slightly tapping the brush 13 on top of the stencil.

However, such conventional stencil brushes have the following problem: Because the handle 11 is made of hard material such as wood, bamboo, or hard plastic, when the user taps the handle 11 to dispense the ink, the impact of the tapping force returns to the fingers through the handle 11, because the force is not absorbed by the hard handle 11, stencil, or paper. Thus, the user receives an impact on the fingers all the time, and the fingers get tired if tapping is continued for a long time period.

Also, because the impact of the force, which taps the stencil brush 13, returns through the handle 11, the handle 11 bounces, and disrupts the close contact between the brush 13 or ink absorbing part 12, the stencil and the paper. Thus, the quantity of ink released from the brush 13 by one time of tapping is small, resulting in the need for more tapping on the stencil brush. The fingers therefore receive impact more frequently, and the hand gets tired.

A need therefore exists for an improved stencil brush.

SUMMARY OF THE INVENTION

It is therefore an object of the present invention to provide an improved stencil brush.

In a first embodiment, the handle of the stencil brush is constructed from a buffer material which provides buffering characteristics. Thus, the impact of the tapping force generated when the stencil brush is used to stencil ink can be absorbed by the buffer material of the handle. Consequently, the hand will not be tired even if the stencil brush is tapped for a long time period. Also, because buffer characteristics are provided by constructing the handle of the stencil brush of a buffer material so the tapping force on the handle is relieved by the buffer material, there will be closer contact between the ink absorbing part, the stencil, and the paper. The quantity of ink applied by one tap increases, and thus the user will need to tap less often.

In another embodiment, the buffer handle is constructed to be held between the user's thumb and middle finger, and is short enough that the user's index finger can comfortably press on the top end of the handle. Thus, the brush can be held comfortably between the user's three fingers, allowing the user to stencil with more control and for long periods of time.

In another embodiment, the buffer handle is constructed to slip over the tip of the user's finger. The buffer handle is bored from the top end along its length to a depth great enough to be retained on the user's finger by the force of friction. By varying the diameter of the bore and/or the elasticity of the buffer material, handles can be made that can be retained on any one of the user's fingers. Selection of brushes with different bores can allow the user to hold more than one brush at a time. The user can stencil more efficiently either by using multiple brushes of a single color, or by having a different colored brush on each finger, eliminating the need to switch brushes for every color change.

In yet another embodiment, the hollow handle is constructed from a rigid material. In this embodiment, the brush can be used as discussed immediately above; however, the rigid material is more durable than the buffer material.

DETAILED DESCRIPTION OF THE INVENTION

The present invention will be explained in concrete terms based on the figures.

Figure 1:
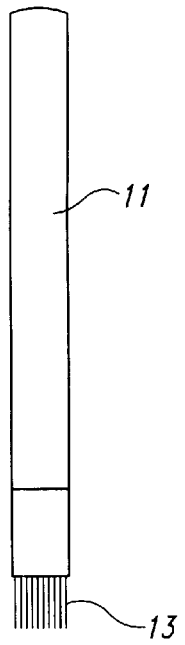
FIG. 1 is a side elevation view of a conventional stencil brush.
Figure 2:
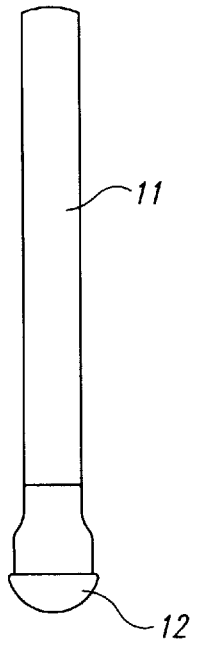
FIG. 2 is a side elevation view of another conventional stencil brush.
Figure 3:
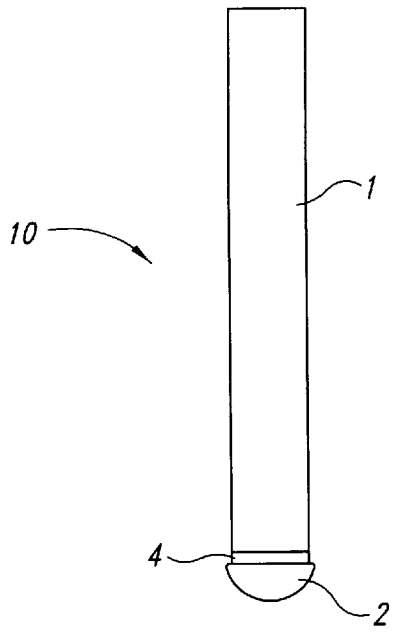
FIG. 3 is a side elevation view of an example of a buffer brush for stenciling according to a first embodiment of the present invention.

FIG. 3 illustrates an example of the buffer brush 10 for stenciling of the present invention. As illustrated in this FIG. 3, the buffer brush 10 of the present invention is characterized by the fact that it is constructed by providing an ink absorbing part 2 on a handle 1 made of buffer material.

The handle 1 is made of buffer material. The buffer material is preferably resilient and has buffering characteristics, while at the same time being hard or firm enough to transmit the tapping force to the ink absorbing part 2. Plastic foaming substances, rubber foaming substances, other foaming substances, or sponges are preferable handle materials. Concrete examples include a plastic foaming substance or sponge of polyethylene-vinyl acetate copolymer ("EVA") and a rubber foaming substance or sponge such as styrene butadiene rubber ("SBR"), nitrile butadiene rubber ("NBR").

There is no specific limit in terms of the cross-sectional shape of the handle 1. The shape of its cross section may be a circle, oval, triangle, quadrangle, hexagon, or other polygon.

The ink absorbing part 2 may be one which is used for conventional stencil brushes. A polyurethane plastic sponge is preferable. Animal hair may also be used.

The buffer brush 10 of the present invention can be easily prepared by gluing the ink absorbing part 2 with an adhesive 4 to the tip of the handle 1 made of buffer material.

Figure 4:
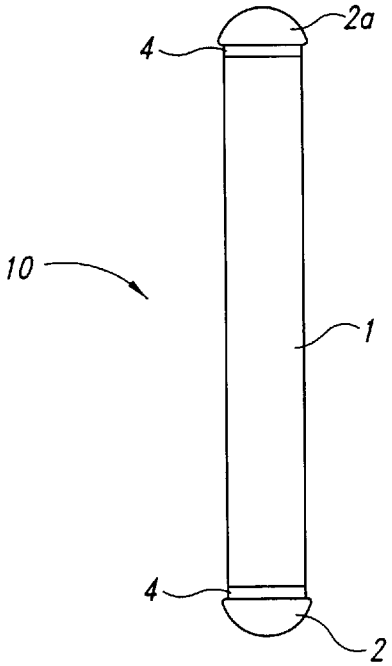
FIG. 4 is a side elevation view of another example of a buffer brush for stenciling according to a second embodiment of the present invention.

In FIG. 3, the ink absorbing part 2 is provided at one end of the handle 1. For the buffer brush 10 of the present design, an ink absorbing part 2*a* may also be provided at the opposite end of the handle 1, as illustrated in FIG. 4. In such a case, with one buffer brush 10, two colors of ink can be used.

The length of the handle 1 of the buffer brush 10 of the embodiment shown in FIG. 3 can vary. For instance, the handle 1 may be long enough for the user to hold with two fingers while tapping it on the stencil in the same manner as holding a pencil. The handle having a handle axis along its length and the handle having an unstressed shape aligned with the handle axis such that the user can hold the handle without first manipulating it.

Figure 5:
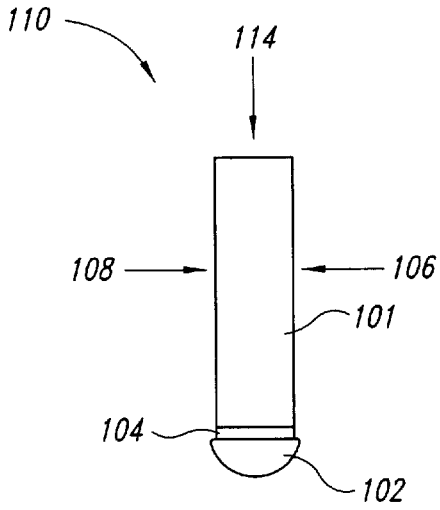
FIG. 5 is a side elevation view of an example of a buffer brush for stenciling according to a third embodiment of the present invention.
Figure 6:
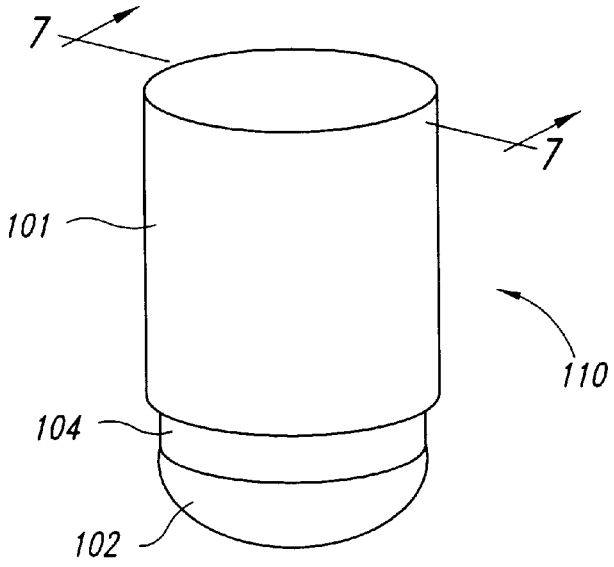
FIG. 6 is an isometric view of the buffer brush for stenciling of FIG. 5.
Figure 7:
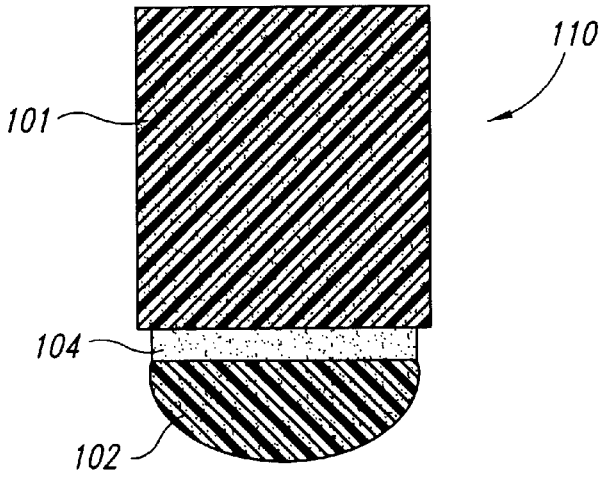
FIG. 7 is a section view of the buffer brush for stenciling of FIG. 6 as viewed along Section 7—7.

As illustrated in FIGS. 5–7, a third embodiment of the present invention is constructed such that the handle 101 is short enough for the user to support a first and second handle walls, 106 and 108 respectively, at a position not too distant from the ink absorbing part 102 between the thumb and middle fingers, respectively, and to simultaneously press the top end 114 of the handle 101 with the index finger. In this embodiment, the handle 101 is preferably 20–30 mm long, although the handle may be shortened or lengthened to satisfy user demands. The preferable length is one where the user can comfortably tap the brush in a stable manner using three fingers, preventing the user's hand from getting tired even if the brush is tapped for a long time period.

FIG. 7 shows a sectional view of the buffer brush 110 according to the section defined in FIG. 6. In the exemplary embodiment, the handle 101 is constructed from solid, synthetic foam or a similar material of the type discussed above. The ink absorbing part 102 is attached to the handle 101, such as by an adhesive 104.

Figure 8:
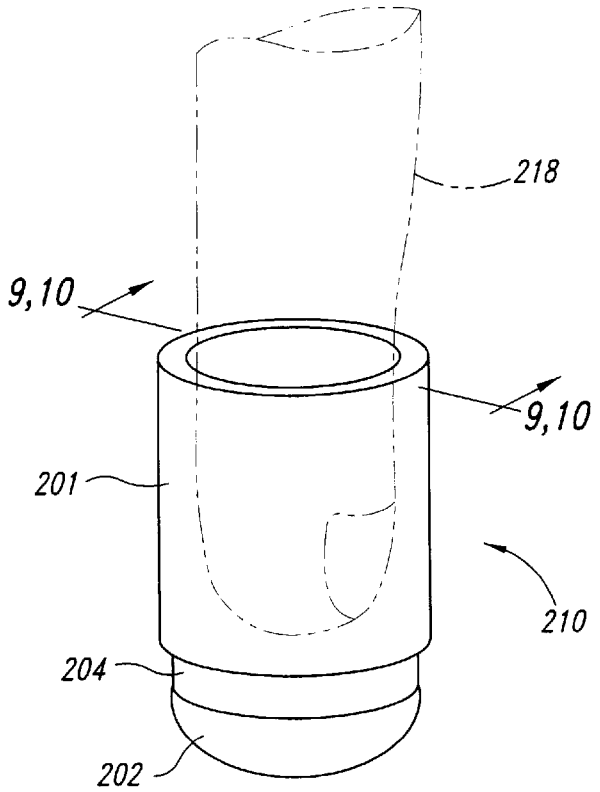
FIG. 8 is an isometric view of a user wearing a buffer brush for stenciling according to a fourth embodiment of the present invention.
Figure 9:
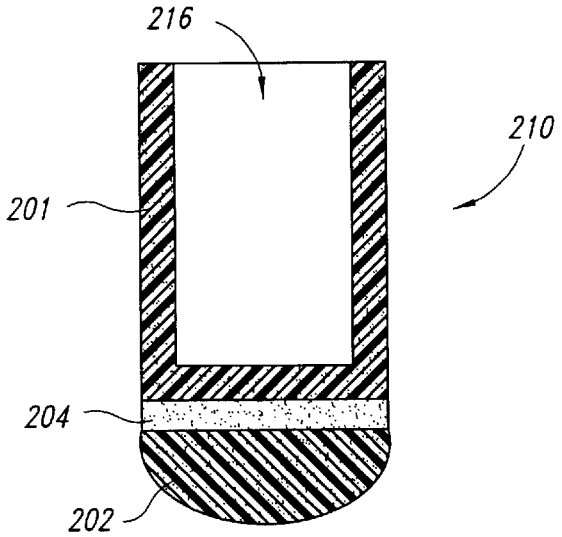
FIG. 9 is a section view of the buffer brush for stenciling of FIG. 8 as viewed along Section 9—9.

FIGS. 8 and 9 show a buffer brush 210 according to a fourth embodiment of the present invention. In this embodiment, the handle 201 includes an orifice 216 into which a user's finger 218 can be inserted. The orifice is preferably approximately 15 mm in diameter, but can vary to accommodate fingers of different size and shape. The handle 201 is constructed of a resilient, buffer material such that, when the user's finger 218 is inserted into the orifice 216, the buffer material of handle 201 resiliently expands. The buffer brush 210 is thereby retained on the user's finger 218 by the restoring force in the walls of the handle 201 gripping the user's finger 218. Various orifice 216 sizes and various materials can be used to allow the buffer brush 210 to accommodate various finger sizes and shapes.

Figure 10:
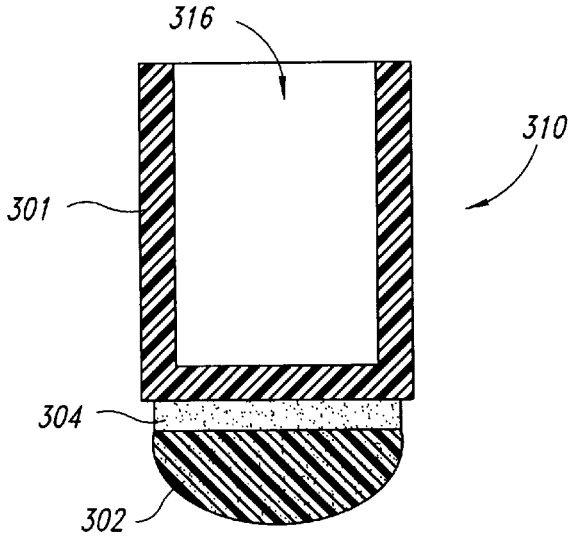
FIG. 10 is a section view of a buffer brush for stenciling according to a fifth embodiment of the present invention.

FIG. 10 shows a buffer brush 310 according to a filth embodiment of the present invention. In this embodiment, the shape of the handle 301 is similar to that shown and described in FIGS. 8 and 9, however, the handle is constructed from a rigid material, such as plastic. Because the walls of the handle 301 are rigid, the orifice 316 does not expand to receive a finger (not shown). Instead, the orifice 316 is specifically sized to captively receive a small range of finger sizes. Upon insertion, the finger is at least partially distorted to conform to the shape of the orifice 316. The buffer brush 310 is thus held onto the finger by friction. The orifice is preferably circular, although an oval or other shapes will also work.

From the foregoing it will be appreciated that, although specific embodiments of the invention have been described herein for purposes of illustration, various modifications may be made without deviating from the spirit and scope of the invention. Accordingly, the invention is not limited except as by the appended claims.

APPLICATION EXAMPLE

The present design will be explained below in concrete terms in reference to application examples.

APPLICATION EXAMPLE 1

A buffer brush 110 for stenciling such as illustrated in FIG. 6 was prepared.

For the buffer material, polyethylene foaming sheet, which is 25 mm thick, was punched with a punching blade, and a handle 101 composed of cylindrical polyethylene foaming substance, which is 25 mm long with the diameter of 10–20 mm, was prepared. At the tip of this polyethylene foaming substance handle 101, an ink absorbing part 102 of polyurethane sponge with a round bottom face of 10–20 mm, which forms a spherical shape upward, was glued to the handle with an adhesive 104.

Stenciling was performed using this buffer brush 110. A stencil with flower designs punched out was fixed onto a sheet of paper, the ink from the stamp pad was applied to the ink absorbing part 102 of the buffer brush 110, and the stenciling was performed by tapping the buffer brush 110 on top of the stencil. By the buffer action of the polyethylene foaming substance of the handle 101, the impact of the tapping force was absorbed, and it did not affect the user's hand. Thus, the user's hand did not get tired even after tapping for a long time period. The tapping force was relieved by the polyethylene foaming substance, and there was close contact between the ink absorbing part 102, the stencil, and the paper.

As explained above, because the handle of the buffer brush for stenciling of several embodiments of the present design is made of buffer material, the impact of the force of tapping the brush is absorbed by the buffer material of the handle, and the hand will not get tired even if the brush is tapped for a long time.

Because the handle was made of buffer material with buffering characteristics, the force of tapping the handle is relieved by the buffer material. Thus, there will be close contact with the ink absorbing part, stencil, and paper, the quantity of ink which is applied by tapping once will be great, and thus, the number of tappings can be reduced.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A brush for stenciling comprising:

a handle having a first end and a second end, the handle being constructed from a foam material and having an opening at the second end for receiving a user's finger; and an ink absorbing member attached to the first end of the handle.

2. The brush for stenciling in accordance with claim 1 wherein the foam material is resilient and stretches to captively receive a user's finger.

3. The brush for stenciling in accordance with claim 1 wherein the distance from the first end to the second end of the handle is approximately 20 mm to 30 mm to provide stability and control during use.

4. The brush for stenciling in accordance with claim 1 wherein the foam material comprises a plastic foaming substance.

5. The brush for stenciling in accordance with claim 4 wherein the plastic foaming substance comprises polyethylene-vinyl acetate copolymer.

6. The brush for stenciling in accordance with claim 1 wherein the foam material comprises a rubber foaming substance.

7. The brush for stenciling in accordance with claim 6 wherein the rubber foaming substance is nitrile butadiene rubber.

8. The brush for stenciling in accordance with claim 6 wherein the rubber foaming substance comprises styrene butadiene rubber.

9. The brush for stenciling in accordance with claim 1 wherein the foam material comprises a sponge.

10. The brush for stenciling in accordance with claim 1 wherein the distance from the first end to the second end is twice the distance across the opening.

11. A brush for stenciling comprising:

a handle having a first end, a second end and a handle axis extending therebetween, the handle being constructed from a foam material, the handle having an unstressed shape that is permanently aligned with the handle axis such that the user can, without manipulating the handle, hold the handle near the first end between a thumb and middle finger and simultaneously press the second end of the handle with an index finger; and an ink absorbing member attached to the first end of the handle.

12. The brush for stenciling in accordance with claim 11 wherein the distance from the first end to the second end of the handle is approximately 20 mm to 30 mm.

13. The brush for stenciling in accordance with claim 11 wherein the foam material comprises a plastic foaming substance.

14. The brush for stenciling in accordance with claim 13 wherein the plastic foaming substance comprises polyethylene-vinyl acetate copolymer.

15. The brush for stenciling in accordance with claim 11 wherein the foam material comprises a rubber foaming substance.

16. The brush for stenciling in accordance with claim 15 wherein the rubber foaming substance is nitrile butadiene rubber.

17. The brush for stenciling in accordance with claim 15 wherein the rubber foaming substance comprises styrene butadiene rubber.

18. The brush for stenciling in accordance with claim 11 wherein the foam material comprises a sponge.

* * * * *

UNITED STATES PATENT AND TRADEMARK OFFICE

CERTIFICATE OF CORRECTION

PATENT NO. : 6,098,237
DATED : August 8, 2000
INVENTOR(S) : Rira Yasoshima

It is certified that error appears in the above-identified patent and that said Letters Patent is hereby corrected as shown below:

Title page,
Item [73], Assignee, shoud read -- Tsukineko, Inc. -- .

The following references should be included in section [56], References Cited, on the title page:

| | | |
|---|---|---|
| --3,142,855 | 8/1964 | Gilchrist |
| 472,017 | 3/1892 | Gartner |
| 1,297,784 | 3/1919 | Birnbaum |
| 2,139,492 | 12/1938 | Fidelman |
| 2,318,365 | 5/1943 | Boysen |
| 3,505,700 | 4/1970 | Rodriguez |
| 4,602,650 | 7/1986 | Pipkin |
| 5,026,541 | 6/1991 | Lanier |
| 5,640,713 | 6/1997 | Ping |
| 5,870,796 | 2/1999 | Yasohima --. |

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*